US009799192B2

(12) United States Patent
Wang et al.

(10) Patent No.: US 9,799,192 B2
(45) Date of Patent: Oct. 24, 2017

(54) INTELLIGENT SHOE FOR THE BLIND

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Haisheng Wang, Beijing (CN); Xue Dong, Beijing (CN); Xiaochuan Chen, Beijing (CN); Xiaoliang Ding, Beijing (CN); Hongjuan Liu, Beijing (CN); Yingming Liu, Beijing (CN); Weijie Zhao, Beijing (CN); Wei Liu, Beijing (CN); Changfeng Li, Beijing (CN); Rui Xu, Beijing (CN); Lei Wang, Beijing (CN); Shengji Yang, Beijing (CN)

(73) Assignees: BOE TECHNOLOGY GROUP CO., LTD. (CN); BEIJING BOE OPTOELECTRONICS TECHNOLOGY CO., LTD. (CN)

( * ) Notice: Subject to any disclaimer, the term of this patent is extended or adjusted under 35 U.S.C. 154(b) by 0 days.

(21) Appl. No.: 15/309,553

(22) PCT Filed: Nov. 4, 2015

(86) PCT No.: PCT/CN2015/093748
§ 371 (c)(1),
(2) Date: Nov. 8, 2016

(87) PCT Pub. No.: WO2016/192302
PCT Pub. Date: Dec. 8, 2016

(65) Prior Publication Data

US 2017/0186300 A1 Jun. 29, 2017

(30) Foreign Application Priority Data

Jun. 5, 2015 (CN) ..... 2015 1 0303233

(51) Int. Cl.
*A43B 7/00* (2006.01)
*G08B 21/04* (2006.01)
(Continued)

(52) U.S. Cl.
CPC ..... *G08B 21/0423* (2013.01); *A43B 3/0021* (2013.01); *A43B 13/14* (2013.01); *A43B 23/0245* (2013.01); *A61H 3/06* (2013.01)

(58) Field of Classification Search
CPC ..... A61B 5/6807; A43B 3/005
(Continued)

(56) References Cited

U.S. PATENT DOCUMENTS 6,210,301 B1 * 4/2001 Abraham-Fuchs .. A61B 5/1036 482/51
7,426,873 B1 * 9/2008 Kholwadwala ..... A43B 3/00 73/777
(Continued)

FOREIGN PATENT DOCUMENTS

CN 201182246 1/2009
CN 102935029 2/2013
(Continued)

OTHER PUBLICATIONS

Written Opinion and International Search Report for PCT/CN2015/093748, English Translation of Written Opinion Attached to Original Document, Completed by the Chinese Patent Office, dated Jan. 28, 2016, All together 13 Pages.
(Continued)

*Primary Examiner* — Kevin Kim
(74) *Attorney, Agent, or Firm* — Brooks Kushman P.C.

(57) ABSTRACT

Disclosed is an intelligent shoe for the blind, which includes a sole and an upper. At least a portion of the sole is provided with multiple pressure sensors for generating pressure sensing signals when the sole is in contact with raised ground
(Continued)

surface. The intelligent shoe further includes a storage chip, used to pre-store a signal characteristic of pressure sensing signals generated when the sole is in contact with a blind sidewalk, and a ata processing chip electrically connected to the multiple pressure sensors and the storage chip, used to compare a signal characteristic of pressure sensing signals from the pressure sensors with the pre-stored signal characteristic, and determine that the sole deviates from the blind sidewalk and send a prompt signal in the case that the signal characteristic of the pressure sensing signals from the pressure sensors is inconsistent with the pre-stored signal characteristic.

10 Claims, 4 Drawing Sheets

(51) Int. Cl.

| | |
|---|---|
| ***A43B 3/00*** | (2006.01) |
| ***A43B 23/02*** | (2006.01) |
| ***A43B 13/14*** | (2006.01) |
| ***A61H 3/06*** | (2006.01) |

(58) Field of Classification Search
USPC ..... 340/665
See application file for complete search history.

(56) References Cited

U.S. PATENT DOCUMENTS

| | | | | |
|---|---|---|---|---|
| 8,384,551 | B2 * | 2/2013 | Ross | A43B 3/0005 340/573.1 |
| 2013/0213144 | A1 * | 8/2013 | Rice | A43B 3/0005 73/862.046 |
| 2014/0330171 | A1 * | 11/2014 | Pan | A61B 5/1117 600/595 |
| 2016/0011091 | A1 * | 1/2016 | Huang | G01N 3/24 73/841 |

FOREIGN PATENT DOCUMENTS

| | | |
|---|---|---|
| CN | 103169598 | 6/2013 |
| CN | 103892993 | 7/2014 |
| CN | 103932445 | 7/2014 |
| CN | 204241002 | 4/2015 |
| CN | 104856845 | 8/2015 |
| CN | 204684109 | 10/2015 |
| KR | 20120081529 | 7/2012 |
| NL | 1036637 | 8/2010 |
| WO | 0187202 | 11/2001 |

OTHER PUBLICATIONS

Chinese Office Action for Chinese Application No. 201510303233.3, English Translation attached to original document, Completed by the Chinese Patent Office, dated Jun. 1, 2016, All together 10 Pages.

* cited by examiner

INTELLIGENT SHOE FOR THE BLIND

CROSS-REFERENCE TO RELATED APPLICATIONS

This application is the U.S. national phase of PCT Application No. PCT/CN2015/093748 filed on Nov. 4, 2015, which claims priority to Chinese Patent Application No. 201510303233.3 filed on Jun. 5, 2015, the disclosures of which are incorporated in their entirety by reference herein.

TECHNICAL FIELD

The present disclosure relates to the field of medical care technologies, and in particular to an intelligent shoe for the blind.

BACKGROUND

With the development of electronic science and technology, people pay more and more attentions to the intelligent health field, and devices assisting the blind in walking draw attention of numerous manufacturers.

At present, navigation devices for the blind on the market mainly utilize Global Positioning System (GPS) network signals and General Packet Radio Service (GPRS) network signals to achieve positioning and provide voice prompts to guide the blind to walk. However, such navigation devices are of complex structures and high costs, and the network signals are easily adversely affected by the weather and buildings; hence, the promotion of the devices is severely limited.

SUMMARY

Technical solutions in the present disclosure provide an intelligent shoe for the blind, which is capable of prompting the blind whether he walks along a right route based on contact between a sole and a ground.

The present disclosure provides an intelligent shoe for the blind, which includes a sole and an upper arranged on the sole. At least a portion of the sole is provided with a plurality of pressure sensors configured to generate pressure sensing signals when the sole is in contact with a raised ground surface and corresponding pressure sensors are pressed. The intelligent shoe further includes:

a storage chip, configured to pre-store a signal characteristic of pressure sensing signals generated by corresponding pressure sensors when the sole is in contact with a blind sidewalk; and a data processing chip electrically connected to the plurality of pressure sensors and the storage chip respectively, configured to a signal characteristic of pressure sensing signals received from the plurality of pressure sensors with the pre-stored signal characteristic, and determine that the sole deviates from the blind sidewalk and send a prompt signal in the case that the signal characteristic of the pressure sensing signals received from the plurality of pressure sensors is inconsistent with the pre-stored signal characteristic.

Optionally, the data processing chip is further configured to determine that the sole deviates from the blind sidewalk and send a prompt signal, in the case that the intelligent shoe is in use and no pressure sensing signal is received within a predetermined period.

Optionally, the storage chip may include: a first storage sub-chip configured to store a first characteristic, where the first characteristic is that a signal distribution pattern of pressure sensing signals comprises one column of combinatorial patterns; a second storage sub-chip configured to store a second characteristic, where the second characteristic is that the signal distribution pattern of the pressure sensing signals comprises at least two columns of combinatorial patterns, the at least two columns of combinatorial patterns are parallel, and a distance between two adjacent columns of combinatorial patterns is equal to a distance between two adjacent strip-like bulges on a blind sidewalk indicating the blind to go straight; and a third storage sub-chip configured to store a third characteristic, where the third characteristic is that that the signal distribution pattern of the pressure sensing signals comprises a plurality of combinatorial patterns arranged in an array, and a distance between two adjacent combinatorial patterns is equal to a distance between two adjacent dot bulges on a warning blind sidewalk. In the signal distribution pattern, the pressure sensing signals are represented by virtual points, and the virtual points are arranged according to coordinates of respective positions at which the pressure sensing signals are generated.

Optionally, the data processing chip may include: a position coordinate determining structure, configured to determine the coordinates of the respective positions at which the received pressure sensing signals are generated; a pattern generating structure, configured to generate the signal distribution pattern in a coordinate system according to the coordinates of the respective positions at which the received pressure sensing signals are generated; and a matching structure, configured to compare the signal distribution pattern with the first characteristic, the second characteristic and the third characteristic respectively, determine that the signal characteristic of the pressure sensing signals received from the plurality of pressure sensors is consistent with the pre-stored signal characteristic in the case that at least a part of the signal distribution pattern matches one of the first characteristic, the second characteristic and the third characteristic, and determine that the signal characteristic of the pressure sensing signals received from the plurality of pressure sensors is inconsistent with the pre-stored signal characteristic in the case that at least a part of the signal distribution pattern does not match any of the first characteristic, the second characteristic and the third characteristic.

Optionally, the plurality of pressure sensors is uniformly arranged on a whole bottom surface of the sole.

Optionally, the plurality of pressure sensors is arranged inside the sole and uniformly distributed along a thickness direction of the sole.

Optionally, the intelligent shoe may further include a vibrator, which is connected to the data processing chip, and configured to receive the prompt signal and vibrate according to the prompt signal for prompting a user that he deviates from the blind sidewalk.

Optionally, the intelligent shoe may further include a voice player connected to the data processing chip. Specifically, the voice player is configured to receive the prompt signal and play a voice according to the prompt signal so as to prompt a user that he deviates from the blind sidewalk.

Optionally, the intelligent shoe may further include a power source and a control switch for turning on and turning off the power source. The upper is provided with the power source and the control switch, and the power source is connected to the storage chip and the data processing chip.

Optionally, each of the plurality of pressure sensors is a ceramic pressure sensor.

At least one of the technical solutions described above in the embodiments of the present disclosure has following beneficial effect. The sole is provided with multiple pressure sensors, the signal characteristic generated when the sole is in contact with the blind sidewalk is pre-stored in the storage chip, the signal characteristic of pressure sensing signals acquired in real time is compared with the pre-stored signal characteristic, thereby accurately determining whether the sole is located in the blind sidewalk and informing the blind in time whether he is walking along a right route.

DETAILED DESCRIPTION OF THE EMBODIMENTS

In order to make technical problems to be solved by the present disclosure and technical solutions and advantages of the present disclosure more apparent, the present disclosure is described hereinafter in detail in conjunction with drawings and specific embodiments.

Figure 1:
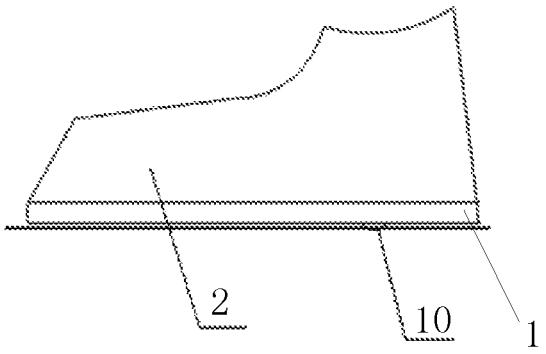
FIG. 1 is a simple schematic structural diagram of an intelligent shoe for the blind according to some embodiments of the present disclosure.

References are made to FIG. 1, which is a schematic structural diagram of an intelligent shoe for the blind according to some embodiments of the present disclosure. The intelligent shoe includes a sole 1 and an upper 2 arranged on the sole 1. At least a portion of the sole 1 is provided with multiple pressure sensors 10 that are used to generate pressure sensing signals when the sole 1 is in contact with a raised ground surface and the pressure sensors 10 are pressed. The intelligent shoe further includes: a storage chip, used to pre-store a signal characteristic of pressure sensing signals generated by the pressure sensors 10 when the sole 1 is in contact with a blind sidewalk and the pressure sensors 10 are pressed; and a data processing chip that is electrically connected to the pressure sensors 10 and the storage chip, and used to compare a signal characteristic of pressure sensing signals received from the pressure sensors 10 with the pre-stored signal characteristic, and determine that the sole deviates from the blind sidewalk and send a prompt signal in the case that the signal characteristic of the pressure sensing signals received from the pressure sensors 10 is inconsistent with the pre-stored signal characteristic.

With the intelligent shoe in the embodiments of the present disclosure, the signal characteristic of the pressure sensing signals that are generated when the sole is in contact with the blind sidewalk and related to a structure characteristic of the blind sidewalk is pre-stored in the storage chip, the pre-stored signal characteristic is compared with a signal characteristic of pressure sensing signals acquired in real time, and it is determined that the sole is in contact with the blind sidewalk in the case that the signal characteristic of the acquired pressure sensing signals in real time is consistent with the pre-stored signal characteristic, else it is determined that the sole deviates from the blind sidewalk and a user is prompted for this condition. It can be identified accurately whether the sole is located on the blind sidewalk by the intelligent shoe having the above-described operating principle, and therefore, the blind can be prompted in time whether he is walking along a right route.

Further, optionally, in the case that the intelligent shoe is in use and no pressure sensing signal is received by the data processing chip in a predetermined period, it is also determined that the sole deviates from the blind sidewalk and a prompt signal is sent by the data processing chip. In this way, when the blind walks out of the blind sidewalk and steps on a flat road, pressures on respective pressure sensors provided for the sole are equal and the data processing chip receives no pressure sensing signal from the pressure sensors; in this case, it is determined that the sole deviates from the blind sidewalk and a prompt signal is sent by the data processing chip in time.

For the intelligent shoe in the present disclosure, the storage chip and the data processing chip may be arranged inside the sole 1; or the upper 2 may be provided with the storage chip and the data processing chip on a surface of the upper 2 or inside the upper 2; or one of the storage chip and the data processing chip may be arranged inside the sole 1 while the upper 2 is provided with the other of the storage chip and the data processing chip.

Figure 2A:
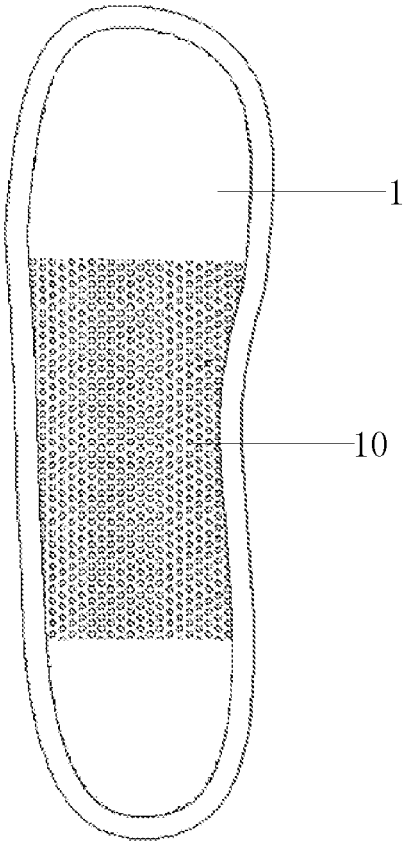
FIG. 2*a* to FIG. 2*c* are schematic structural diagrams showing arrangements of pressure sensors for a sole of an intelligent shoe according to some embodiments of the present disclosure.
Figure 2B:
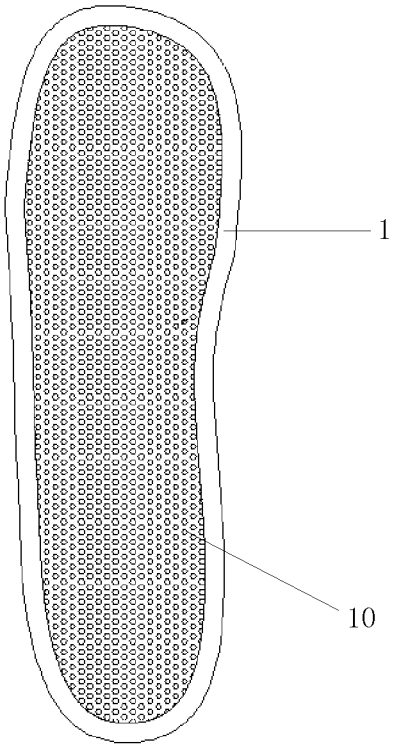
Figure 2C:
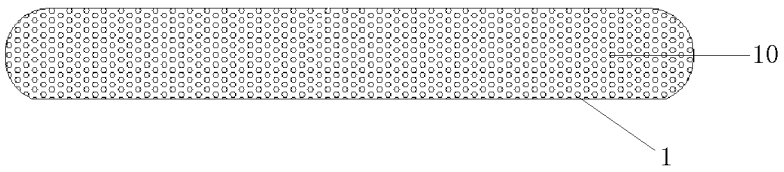

FIG. 2*a* to FIG. 2*c* are schematic structural diagrams showing arrangements of pressure sensors for the sole 1 of the intelligent shoe according to some embodiments of the present disclosure. In a first structure, a portion of a bottom surface of the sole 1 is provided with the pressure sensors 10, and preferably, the pressure sensors 10 are centrally arranged in a middle region of the bottom surface of the sole 1. In a second structure, the pressure sensors 10 are uniformly arranged on a whole bottom surface of the sole 1. In a third structure, the pressure sensors 10 are arranged inside the sole 1 and uniformly distributed along a thickness direction of the sole 1.

Optionally, pressure sensors 10 may be arranged in a manner combining the first structure and the third structure, i.e., in addition that a portion of the bottom surface of the sole 1 is provided with pressure sensors 10, pressure sensors 10 are uniformly arranged inside the sole 1 along a thickness direction of the sole 1. Optionally, pressure sensors 10 may be disposed in a manner combining the second structure and the third structure, i.e., in addition that pressure sensors 10 are uniformly arranged on a whole bottom surface of the sole 1, pressure sensors 10 are uniformly arranged inside the sole 1 along a thickness direction of the sole 1.

Arrangement of pressure sensors for the sole 1 is not limited to the above arrangement manners, provided that a bulge on the road in contact with the sole can be detected. Optionally, the pressure sensors 10 may be ceramic pressure sensors or may be other types of pressure sensors, provided that pressures generated when the sole is in contact with the blind sidewalk can be sensed by the pressure sensors.

For the intelligent shoe in the embodiments of the present disclosure, the storage chip includes: a first storage sub-chip used to store a first characteristic, where the first characteristic is that a signal distribution pattern of pressure sensing signals includes one column of combinatorial patterns; a second storage sub-chip used to store a second characteristic, where the second characteristic is that the signal distribution pattern of the pressure sensing signals includes at least two columns of combinatorial patterns, the at least two columns of combinatorial patterns are parallel, and a distance between two adjacent columns of combinatorial patterns is equal to a distance between two adjacent strip-like bulges on a blind sidewalk indicating the blind to go straight; and a third storage sub-chip used to store a third characteristic, where the third characteristic is that the signal distribution pattern of the pressure sensing signals includes multiple combinatorial patterns that are arranged in an array, and a distance between two adjacent combinatorial patterns is equal to a distance between two adjacent dot bulges on a warning blind sidewalk. In the signal distribution pattern, the pressure sensing signals are represented by virtual points, and the virtual points are arranged according to coordinates of positions at which the pressure sensing signals are respectively generated.

Figure 3A:
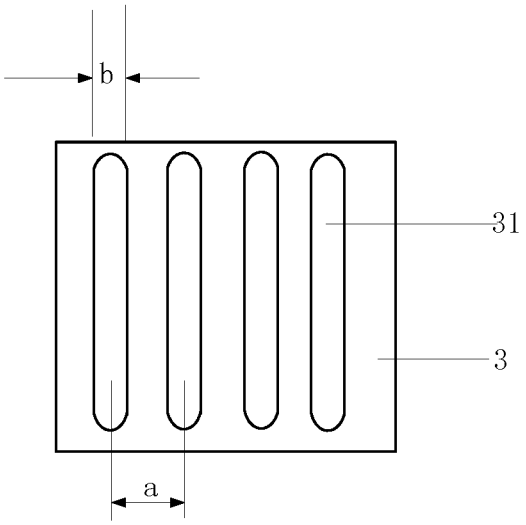
FIG. 3*a* and FIG. 3*b* are schematic plan diagrams of a blind sidewalk indicating the blind to go straight and a warning blind sidewalk respectively.
Figure 3B:
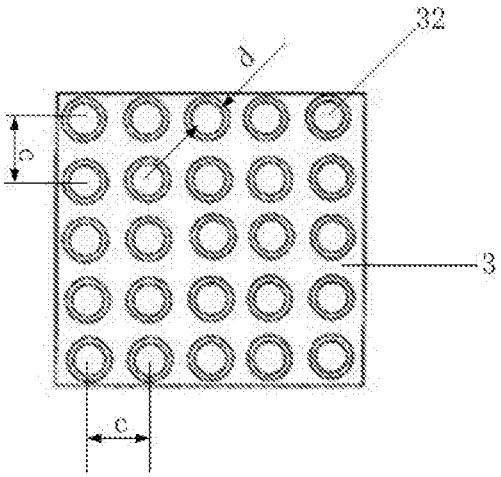

Schematic plan views of a blind sidewalk indicating the blind to go straight and a warning blind sidewalk are illustrated respectively in FIG. 3*a* and FIG. 3*b*. As will be appreciated by the skilled in the art, the blind sidewalk indicating the blind to go straight and the warning blind sidewalk are usually designed in compliance with international standards. As shown in FIG. 3*a*, a size of a blind brick 3 of the blind sidewalk indicating the blind to go straight and related parameters of strip-like bulges arranged on a surface of the blind brick 3 must meet certain standards, for example, a distance a between two adjacent strip-like bulges 31 in parallel is often 62 mm, and a width b of each strip-like bulge 31 is 25 mm. As shown in FIG. 3*b*, a size of a blind brick 3 of the warning blind sidewalk and related parameters of dot bulges arranged on a surface of the blind brick 3 must meet certain standards, for example, a distance c between two adjacent dot bulges 32 in either a horizontal direction or in a vertical direction is 50 mm, and a diameter d of each dot bulge 32 is 25 mm.

Figure 4A:
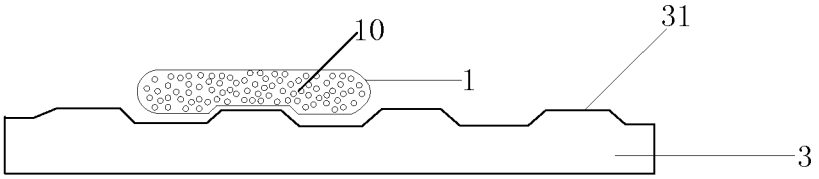
FIG. 4*a* is a schematic diagram of a first structure of a contact manner between a sole and a blind sidewalk indicating the blind to go straight.
Figure 4B:
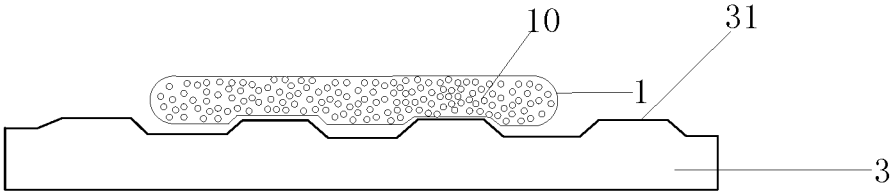
FIG. 4*b* is a schematic diagram of a second structure of a contact manner between a sole and a blind sidewalk indicating the blind to go straight.

With the bulges of the above standard sizes arranged on the blind sidewalk indicating the blind to go straight and the warning blind sidewalk, a region in which pressed pressure sensors 10 are distributed is consistent with the shape and size of bulges on the blind sidewalk when the sole 1 provided with the pressure sensors 10 is in contact with the blind sidewalk. For example, when the sole 1 is in contact with the blind sidewalk indicating the blind to go straight, a contact manner between the sole 1 and strip-like bulges 31 on the blind brick 3 may be in a first form as shown in FIG. 4*a*, i.e., the sole 1 is only in contact with one strip-like bulge 31, pressed pressure sensors 10 form one column of combinatorial patterns on the sole 1, and the distribution of the pressed pressure sensors 10 is consistent with the first characteristic. A contact manner between the sole 1 and strip-like bulges 31 on the blind brick 3 may be in a second form as shown in FIG. 4*b*, i.e., the sole 1 is in contact with two strip-like bulges 31, pressed pressure sensors 10 form two parallel columns of combinatorial patterns on the sole 1, and the distribution of the pressed pressure sensors 10 is consistent with the second characteristic. Of course, the sole 1 may be in contact with three strip-like bulges 31. When the sole 1 is in contact with the warning blind sidewalk, combined with FIG. 3*b*, the sole 1 is in contact with and pressed by multiple dot bulges 32 on the blind brick 3, pressed pressure sensors 10 are spaced apart on the sole 1 and form combinatorial patterns distributed in an array, and the distribution of the pressed pressure sensors 10 is consistent with the third characteristic.

Based on the above principle, the first characteristic, the second characteristic and the third characteristic are respectively stored in the first storage sub-chip, the second storage sub-chip and the third storage sub-chip of the storage chip, when the data processing chip receives pressure sensing signals from pressed pressure sensors 10 due to contact between the sole 1 and the blind sidewalk, the data processing chip determines coordinates of respective positions at which the received pressure sensing signals are generated, generates a signal distribution pattern in a coordinate system according to the coordinates of the respective positions at which the received pressure sensing signals are generated, and compares the signal distribution pattern with the first characteristic, the second characteristic and the third characteristic stored in the storage chip, thereby determining whether the sole 1 is properly located in the blind sidewalk.

Therefore, the data processing chip includes:

a position coordinate determining structure, used to determine the coordinates of the respective positions at which the received pressure sensing signals are generated;

a pattern generating structure, used to generate a signal distribution pattern in a coordinate system according to the coordinates of the respective positions at which the received pressure sensing signals are generated; and a matching structure, used to compare the signal distribution pattern with the first characteristic, the second characteristic and the third characteristic respectively, determine that a signal characteristic of the pressure sensing signals received from the pressure sensors is consistent with the pre-stored signal characteristic in the case that at least a part of the signal distribution pattern matches one of the first characteristic, the second characteristic and the third characteristic, and determine that the signal characteristic of the pressure sensing signals received from the pressure sensors is inconsistent with the pre-stored signal characteristic in the case that at least a part of the signal distribution pattern does not match any of the first characteristic, the second characteristic and the third characteristic.

The data processing chip, provided with the position coordinate determining structure, the pattern generating structure and the matching structure, can generate the signal distribution pattern of the pressed pressure sensors 10, and compare the signal distribution pattern with various pre-stored possible signal characteristics of pressure sensing signals generated by pressure sensors when the sole is in contact with the blind sidewalk and the pressure sensors are pressed. The data processing chip can determine whether the sole is located properly in the blind sidewalk or deviates from the blind sidewalk accurately, and may send a prompt signal when it is determined that the sole deviates from the blind sidewalk.

Further, based on the structure and manner described above, using the position coordinate determining structure, the pattern generating structure and the matching structure, the data processing chip may compare the generated signal distribution pattern with the various pre-stored possible signal characteristics of pressure sensing signals generated by pressure sensors when the sole is in contact with the blind sidewalk and the pressure sensors are pressed, and the matching structure can determine the type of the blind sidewalk with which the sole is in contact in the case that the signal distribution pattern matches any of the various pre-stored possible signal characteristics. For example, it is determined that the sole is in contact with the blind sidewalk indicating the blind to go straight in the case that the generated signal distribution pattern is consistent with the first characteristic or the second characteristic, and it is determined that the sole is in contact with the warning blind sidewalk in the case that the generated signal distribution pattern is consistent with the third characteristic. In view of the foregoing, optionally, the data processing chip may be further used to send a prompt signal indicating the type of the blind sidewalk with which the sole is in contact, and the prompt signal can be played through a voice player installed on the intelligent shoe, such that the user can be informed in real time of the type of the blind sidewalk in a voice playing manner.

Optionally, the intelligent shoe may further include a voice player connected to the data processing chip. The voice player is used to receive a prompt signal, and play a voice according to the prompt signal so as to prompt the user that he deviates from the blind sidewalk or inform the user of the type of the blind sidewalk.

In other aspect, the intelligent shoe may include a vibrator, which is connected to the data processing chip, and used to receive a prompt signal and vibrate according to the prompt signal for prompting the user that he deviates from the blind sidewalk.

The upper 2 may be provided with the voice player and/or the vibrator.

In other aspect, the intelligent shoe may further include a power source and a control switch for turning on or turning off the power source, and the upper 2 is provided with the power source and the control switch. The power source is connected to the storage chip and the data processing chip, thereby supplying power for the storage chip and the data processing chip.

Further, since the control switch is connected to the power source, when it is necessary to initiate the intelligent shoe, the control switch is switched on such that the power source supplies power for the storage chip and the data processing chip and the storage chip and the data processing chip can operate; when the intelligent shoe is not to be used, the control switch is switched off such that the power source no longer supplies power for the storage chip and the data processing chip.

For the intelligent shoe for the blind in the embodiments of the present disclosure, the sole is provided with multiple pressure sensors, the signal characteristic generated when the sole is in contact with the blind sidewalk is pre-stored in the storage chip, the signal characteristic of pressure sensing signals acquired in real time is compared with the pre-stored signal characteristic, thereby accurately determining whether the sole is located in the blind sidewalk and informing the blind in time whether he is walking along a right route.

Those described above are preferred embodiments of the present disclosure. It should be noted that, the skilled in the art can make improvements and modifications without departing from the principle of the disclosure, and those improvements and modifications all fall in the scope of protection of the present disclosure.

What is claimed is:

1. An intelligent shoe for the blind, comprising a sole and an upper arranged on the sole, wherein at least a portion of the sole is provided with a plurality of pressure sensors configured to generate pressure sensing signals when the sole is in contact with a raised ground surface and corresponding pressure sensors are pressed;

wherein the intelligent shoe further comprises:

a storage chip, configured to pre-store a signal characteristic of pressure sensing signals generated by corresponding pressure sensors when the sole is in contact with a blind sidewalk; and a data processing chip electrically connected to the plurality of pressure sensors and the storage chip, configured to compare a signal characteristic of pressure sensing signals received from the plurality of pressure sensors with the pre-stored signal characteristic, and determine that the sole deviates from the blind sidewalk and send a prompt signal in the case that the signal characteristic of the pressure sensing signals received from the plurality of pressure sensors is inconsistent with the pre-stored signal characteristic.

2. The intelligent shoe according to claim 1, wherein the data processing chip is further configured to determine that the sole deviates from the blind sidewalk and send a prompt signal, in the case that the intelligent shoe is in use and no pressure sensing signal is received within a predetermined period.

3. The intelligent shoe according to claim 1, wherein the storage chip further comprises:

a first storage sub-chip configured to store a first characteristic, wherein the first characteristic is that a signal distribution pattern of pressure sensing signals comprises one column of combinatorial patterns;

a second storage sub-chip configured to store a second characteristic, wherein the second characteristic is that the signal distribution pattern of the pressure sensing signals comprises at least two columns of combinatorial patterns, the at least two columns of combinatorial patterns are parallel, and a distance between two adjacent columns of combinatorial patterns is equal to a distance between two adjacent strip-like bulges on a blind sidewalk indicating the blind to go straight; and a third storage sub-chip configured to store a third characteristic, wherein the third characteristic is that that the signal distribution pattern of the pressure sensing signals comprises a plurality of combinatorial patterns arranged in an array, and a distance between two adjacent combinatorial patterns is equal to a distance between two adjacent dot bulges on a warning blind sidewalk;

wherein in the signal distribution pattern, the pressure sensing signals are represented by virtual points, and the virtual points are arranged according to coordinates of respective positions at which the pressure sensing signals are generated.

4. The intelligent shoe according to claim 3, wherein the data processing chip comprises:

a position coordinate determining structure, configured to determine the coordinates of the respective positions at which the received pressure sensing signals are generated;

a pattern generating structure, configured to generate the signal distribution pattern in a coordinate system according to the coordinates of the respective positions at which the received pressure sensing signals are generated; and a matching structure, configured to compare the signal distribution pattern with the first characteristic, the second characteristic and the third characteristic respectively, determine that the signal characteristic of the pressure sensing signals received from the plurality of pressure sensors is consistent with the pre-stored signal characteristic in the case that at least a part of the signal distribution pattern matches one of the first characteristic, the second characteristic and the third characteristic, and determine that the signal characteristic of the pressure sensing signals received from the plurality of pressure sensors is inconsistent with the pre-stored signal characteristic in the case that at least a part of the signal distribution pattern does not match any of the first characteristic, the second characteristic and the third characteristic.

5. The intelligent shoe according to claim 1, wherein the plurality of pressure sensors is uniformly arranged on a whole bottom surface of the sole.

6. The intelligent shoe according to claim 1, wherein the plurality of pressure sensors is arranged inside the sole and uniformly distributed along a thickness direction of the sole.

7. The intelligent shoe according to claim 1, further comprising a vibrator, which is connected to the data processing chip, and configured to receive the prompt signal and vibrate according to the prompt signal for prompting a user that he deviates from the blind sidewalk.

8. The intelligent shoe according to claim 1, further comprising a voice player connected to the data processing chip, wherein the voice player is configured to receive the prompt signal and play a voice according to the prompt signal so as to prompt a user that he deviates from the blind sidewalk.

9. The intelligent shoe according to claim 1, further comprising a power source and a control switch for turning on and turning off the power source, wherein the upper is provided with the power source and the control switch, and the power source is connected to the storage chip and the data processing chip.

10. The intelligent shoe according to claim 1, wherein each of the plurality of pressure sensors is a ceramic pressure sensor.

* * * * *